United States Patent [19]

Gibas

[11] 4,439,751

[45] Mar. 27, 1984

[54] DIRECT CURRENT ELECTROMAGNET

[75] Inventor: Christoph Gibas, Neunkirchen, Fed. Rep. of Germany

[73] Assignee: bso Steuerungstechnik GmbH, Sulzbach-Saar, Fed. Rep. of Germany

[21] Appl. No.: 444,697

[22] Filed: Nov. 26, 1982

[30] Foreign Application Priority Data

Nov. 27, 1981 [DE] Fed. Rep. of Germany ..... 3147058

[51] Int. Cl.[3] ..... H01F 7/00

[52] U.S. Cl. ..... 335/278; 335/281

[58] Field of Search ..... 335/276, 278, 281, 297, 335/301

[56] References Cited

U.S. PATENT DOCUMENTS 1,556,363 6/1925 Smith .
3,098,135 7/1963 Farmer ..... 335/281
3,295,079 12/1966 Brown ..... 335/278 X
3,451,022 6/1969 Krautwald et al. ..... 335/281
3,593,240 7/1971 Garczyski ..... 335/281 X
4,186,363 1/1980 Schmidt et al. ..... 335/278

FOREIGN PATENT DOCUMENTS 1489975 2/1969 Fed. Rep. of Germany .
517997 1/1972 Switzerland .

*Primary Examiner*—George Harris
*Attorney, Agent, or Firm*—Walter C. Farley

[57] ABSTRACT

An actuating magnet, particularly a direct current electromagnet, has a cylindrical magnetically permeable shell or cover made from a rectangular sheet of metal bent into a square cylinder, the edges of the sheet forming a gap. Pole plates on the ends of the shell have recesses on their edges to receive projections on the shell. The pole plates have recesses in the corners, leaving the corners uncovered to receive fastening screws.

2 Claims, 6 Drawing Figures

DIRECT CURRENT ELECTROMAGNET

This invention relates to an actuating magnet, particularly an electromagnet which can be energized by direct current.

BACKGROUND OF THE INVENTION

It is known to provide an electromagnet of a type which has a coil surrounding a pole with an external magnetic circuit enclosing the coil and usually partly enclosing the pole with one or more end pole pieces. In one known actuating magnet of this general type, the outer cover which forms the magnetic exciting circuit is formed of two prismatically curved or U-shaped stator laminations which are welded together with the pole plate and these are mounted within the cover. An actuating magnet having a magnetic circuit cover of this type is costly to manufacture and occupies considerable space since, seen transversely, the square area enclosed within the cover corresponds, at a minimum, to the outer diameter of the coil. A structure of this type is shown in Swiss Pat. No. 517,997.

U.S. Pat. No. 1,556,363 shows an electromagnetic device having an outer housing which is square in transverse cross-section with a pole plate inserted on one side and held against rotation by means of closed recesses in the cover, and it is also held in the axial direction. The pole plate at the other end is U-shaped in transverse cross-section, the turned-down shanks of the pole plate engaging recesses in the cover. The position of the pole plate on the cover is also assured by means of a pivot pin. An armature is disposed between the pole plate and the coil where it is pivotable about the pivot pin. The actuating magnet structure is of extremely complicated configuration and can be manufactured only at great cost.

In yet another known actuating magnet structure, the cover or housing likewise consists of two U-shaped parts which are either connected tightly by means of the pole plates, the parts of the cover projecting axially over the pole plates and being plastically deformed by rivet jointing. This is shown in German Offenlengungsschrift No. 14 89 975.

BRIEF DESCRIPTION OF THE INVENTION

An object of the present invention is to provide a structure for an actuating magnet which permits the assembly to be manufactured and put together at low cost and in a simple fashion.

Briefly described, the invention includes an actuating magnet, particularly a direct current electromagnet, of the type having a circular cylindrical coil surrounding a pole body, comprising the combination of a magnetic shell substantially surrounding the coil and forming a part of the exciting magnetic circuit for the electromagnet, said shell being formed from a single generally rectangular sheet of metal bent to form a substantially square cylinder, means defining axially elongated openings through said shell, said openings being spaced apart so that they lie at the corners of said cylinder to facilitate bending thereof, the axial length of each said opening being greater than half the axial length of said cylinder, the sides of said cylinder being bent concave outwardly to conform to said coil; first and second pole plates at opposite ends of said cylinder; interengaging means on said pole plates and said shell to prevent rotation of said plates; and means on said pole plates defining recesses adjacent the corners of said shell for permitting passage of fasteners therethrough.

As will be seen, the shell or cover and the pole plates can be manufactured and formed in a very simple manner without requiring additional work steps after the initial assembly to form a connection between the pole plates and the cover. The corners of the cover are easily bent into the desired shape because of the openings cut into the regions which become the corners, and it is thus possible to easily arch the middle parts of the side walls of the cover outwardly to obtain a space saving structure and also to obtain adaptation to the shape of a plastic cover for the energizing coil. The plastic cover thus lies like a lamina on the housing and provides guide surfaces to guide the cover which encompasses the spool which carries the exciting winding. The recesses in the pole plates at the housing or shell corners also permit easier working by bending of the cover during manufacture so that the parts need not be removed later.

Satisfactory contact of the pole plates with the magnetically permeable shell, to facilitate the transfer of lines of force, is attained by firm interconnection of these components.

In order that the manner in which the foregoing and other objects are attained in accordance with the invention can be understood in detail, particularly advantageous embodiments thereof will be described with reference to the accompanying drawings, which form a part of this specification, and wherein.

Figure 2:
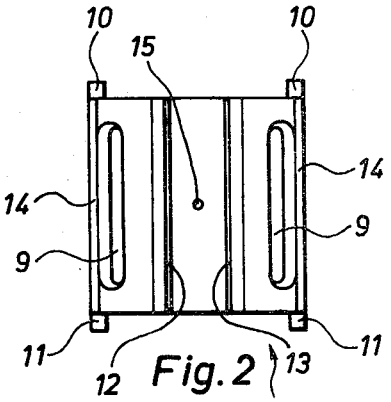
FIG. 2 is a side elevation of the magnetically permeable shell portion of the assembly of FIG. 1.
Figure 5:
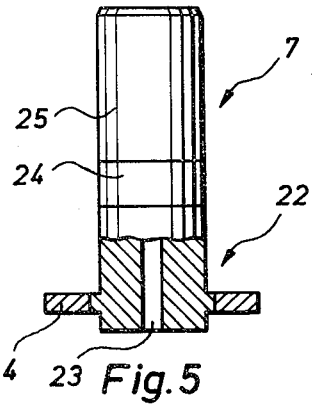
FIG. 5 is a side elevation, in partial section, of an assembled pole piece and pole plate structure.
Figure 3:
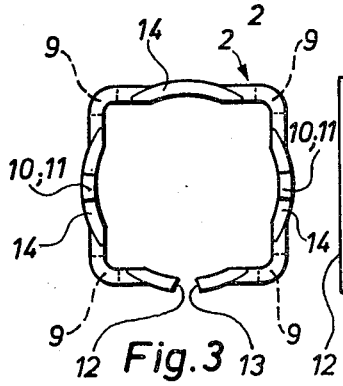
FIG. 3 is a top plan view of the shell of FIG. 2.

An electromagnetic device in accordance with the invention, indicated generally at 1, includes a magnetically permeable external shell 2 which is shown separately in FIGS. 2 and 3, and pole plates 3 and 4 at the top and bottom ends thereof. A coil spool 6 supporting a winding 5 is mounted in and substantially closed by shell 2 and has a pole body 7 extending coaxially through the coil, the pole being shown apart from the rest of the structure in FIG. 5 firmly attached with the bottom pole piece 4.

Figure 6:
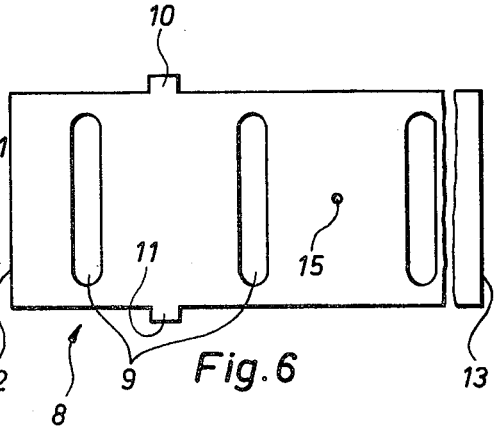
FIG. 6 is a plan view of a rectangular metal plate shaped to be bent into a shell as shown in FIGS. 2 and 3.

Shell 2 is formed from a stamped metal sheet which is separately shown in an "unrolled" or unbent state in FIG. 6. As illustrated therein, the basic component is a rectangular sheet of metal 8 which has elongated rectangular openings 9 spaced from each other by appropriate distances such that, when the sheet 8 is bent into a square cylinder such as illustrated in FIGS. 2 and 3, the openings 9 occupy the corner locations. Thus, openings 9 must be equally spaced from each other along the sheet with the longitudinal axes of the openings extending perpendicular to the longitudinal axis of the metal sheet 8 in its unbent form. The openings 9 are of a length equal to approximately 80 percent of the width of sheet 8, or of the axial height of the formed shell 2, and each opening has a width which is approximately 20 percent of the height of the shell. The openings should be at least greater than half of the axial length of the formed shell. The openings 9 are dimensioned, in any case, such that cross pieces remain at both ends thereof. Rectangular projections 10 and 11 are formed on the longer sides, or the top and bottom, of sheet metal element 8 and are positioned so that they occur at the top and bottom of opposite walls of the formed shell, between the end pairs of openings 9.

Thus, as shown in FIGS. 2 and 3, when the sheet metal element 8 is bent into the shape shown, which constitutes essentially a cylinder which is square in cross-section, the short edges 12, 13 of the metal sheet are spaced apart from each other, forming a gap. The openings 9 are positioned in the corners of the square and facilitate the bending of element 8. In addition, the mid portions 14 of each of the three sides of the cylinder, and the portions on either side of the gap defined by edges 12 and 13, are formed with an outwardly arched shape to adapt to the curvature of winding 5 and coil 6. A hole 15 in the middle of element 8 is simply provided to hold it in position during the treatment process.

Figure 1:
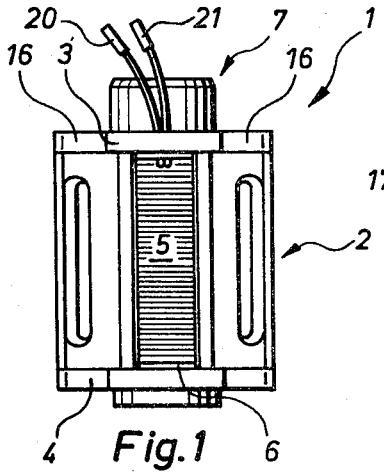
FIG. 1 is a side elevation of an actuating magnet in accordance with the invention.
Figure 4:
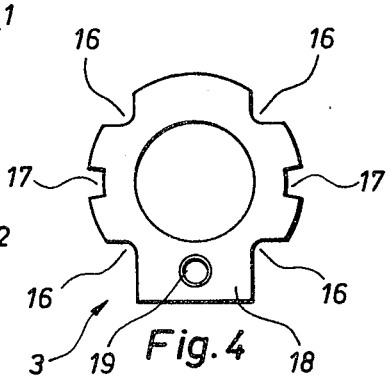
FIG. 4 is a top plan view of a pole plate usable in the assembly of FIG. 1.

FIG. 4 shows a pole plate 3 which has a central opening to receive pole body 7 and has recesses 16 on opposite side edges all of which have the same sector angles which, in the position shown in FIG. 1, lie over the corners of shell 2. These recesses allow for easy bending of the corners during manufacture and also leave space for axially extending fastening screws. Two recesses 17 on opposite sides of plate 3 are positioned between the pairs of recesses 16 in the corners to engage the opposite projections 10 formed on shell 2 for the purpose of precisely positioning plate 3 on the shell. Pole plate 3 has a radial projection between recesses 16, forming a projection 18 in which is provided a bore 19 for the passage of wires 20, 21 from winding 5. Plate 3 can also be configured for the use of a plug-type connector.

Pole plate 4 has a configuration which corresponds to that of plate 3 in having recesses 16 and 17, but lacks the radial projection 18. Projections 11 on shell 2 engage openings 17 in plate 4, thereby positively positioning plate 4. Plate 4 is firmly attached to a relatively short flange-like projection surrounding pole core 22 of body 7, with no clearance. The plate 4 is preferably mounted on body 22 by a press fit. Core 22 supports two sleeves 24 and 25, in sequence, the middle sleeve 24 being of a non-magnetic material. Shell 2, plates 3 and 4, and pole body 7 and the other structural components, except for sleeve 24, are of a magnetically permeable material.

As will be recognized, between winding 5 and shell 2 there is space in each corner through which fastening screws can axially extend.

After assembly of coil structure 5, 6 in shell 2 and after superpositioning pole plates 3 and 4 on the shell, axial force is applied to shell 2 and pole plates 3, 4 are impressed in the relevant front sides of shell 2 in the area of the middle 14 of those sides, thus properly positioning plates 3, 4 on the shell 2.

Coil structure 6 can also be so arranged in shell 2 that the wire 20, 21 project downwardly and pass through a bore in plate 4 which is then shaped as shown in FIG. 4.

While one advantageous embodiment has been chosen to illustrate the invention, it will be understood by those skilled in the art that various changes and modifications can be made therein without departing from the scope of the invention as defined in the appended claims.

What is claimed is:

1. An actuating magnet, particularly a direct current electromagnet, of the type having a circular cylindrical coil surrounding a pole body, comprising the combination of a magnetic shell substantially surrounding the coil and forming a part of the exciting magnetic current for the electromagnet, said shell being formed from a single generally rectangular sheet of metal bent to form a substantially square cylinder, means defining axially elongated openings through said shell, said openings being spaced apart so that they lie at the corners of said cylinder to facilitate bending thereof, the axial length of each said opening being greater than half the axial length of said cylinder, the sides of said cylinder being bent concave outwardly to conform to said coil;

first and second pole plates at opposite ends of said cylinder;

interengaging means on said pole plates and said shell to prevent rotation of said plates; and means on said pole plates defining recesses adjacent the corners of said shell for permitting passage of fasteners therethrough.

2. A magnet according to claim 1 wherein said shell includes means defining an impression at the front thereof corresponding to the associated pole plates.

* * * * *